US011801527B2

(12) United States Patent
Wilkens et al.

(10) Patent No.: US 11,801,527 B2
(45) Date of Patent: Oct. 31, 2023

(54) METHODS AND SYSTEMS FOR APPLYING SEALANT

(71) Applicant: American Honda Motor Co., Inc., Torrance, CA (US)

(72) Inventors: Kevin Michael Wilkens, Hilliard, OH (US); Michael Dale Bullard, Sophia, NC (US); John Jeffrey Carter, Marysville, OH (US); Terry John Taylor, Howell, MI (US)

(73) Assignee: American Honda Motor Co., Inc., Torrance, CA (US)

( * ) Notice: Subject to any disclaimer, the term of this patent is extended or adjusted under 35 U.S.C. 154(b) by 203 days.

(21) Appl. No.: 17/024,989

(22) Filed: Sep. 18, 2020

(65) Prior Publication Data

US 2021/0078031 A1 Mar. 18, 2021

Related U.S. Application Data

(60) Provisional application No. 62/902,116, filed on Sep. 18, 2019.

(51) Int. Cl.

| | |
|---|---|
| ***B05C 5/02*** | (2006.01) |
| ***B05B 12/26*** | (2018.01) |
| ***B05C 17/005*** | (2006.01) |

(52) U.S. Cl.

CPC ..... *B05C 5/0212* (2013.01); *B05B 12/26* (2018.02); *B05C 5/0216* (2013.01); *B05C 17/00503* (2013.01); *B05C 17/00516* (2013.01)

(58) Field of Classification Search

None

See application file for complete search history.

(56) References Cited

U.S. PATENT DOCUMENTS

| | | | | |
|---|---|---|---|---|
| 2,710,113 | A | 6/1955 | Pritchard | |
| 3,645,816 | A | 2/1972 | Billias et al. | |
| 9,757,759 | B2 | 9/2017 | Topf et al. | |
| 9,884,329 | B2 | 2/2018 | Pringle, IV et al. | |
| 9,975,137 | B2 | 5/2018 | Trend et al. | |
| 10,583,444 | B2 * | 3/2020 | Pringle, IV | B05D 1/26 |
| 11,027,307 | B2 * | 6/2021 | Domenighi | B05C 17/00516 |
| 2014/0272109 | A1 * | 9/2014 | Mårtensson et al. | B41J 2/14 239/536 |

(Continued)

FOREIGN PATENT DOCUMENTS

| | | | |
|---|---|---|---|
| CN | 105268595 | A | 1/2016 |
| JP | 6071359 | B2 | 2/2017 |

*Primary Examiner* — Jethro M. Pence

(74) *Attorney, Agent, or Firm* — Stinson LLP

(57) ABSTRACT

A nozzle applies a sealant to a target area that includes a coupling member and an elongated seam. The nozzle includes a primary portion positionable in line with the coupling member in the target area, a first secondary portion on a first side of the primary portion, and a second secondary portion on a second side of the primary portion. The primary portion is in fluid communication with one or more material sources. The first secondary portion extends from the primary portion such that the first secondary portion is configured to extend over at least a segment of the elongated seam in the target area when the primary portion is positioned in line with the coupling member in the target area. The first secondary portion has a first height, and the second secondary portion has a second height less than the first height.

10 Claims, 11 Drawing Sheets

(56) References Cited

U.S. PATENT DOCUMENTS

| | | | | |
|---|---|---|---|---|
| 2015/0075424 | A1* | 3/2015 | Lim | B05C 5/0254 239/597 |
| 2015/0217326 | A1* | 8/2015 | Nawata | B29C 48/06 425/461 |
| 2015/0246368 | A1* | 9/2015 | Ikushima | F04B 9/10 222/1 |
| 2016/0129470 | A1* | 5/2016 | Tada | B05C 5/0295 118/323 |
| 2016/0288924 | A1 | 10/2016 | Humfeld et al. | |
| 2018/0052364 | A1 | 2/2018 | Larrabee et al. | |

* cited by examiner

METHODS AND SYSTEMS FOR APPLYING SEALANT

CROSS REFERENCE TO RELATED APPLICATION

This application claims the benefit of U.S. Provisional Application No. 62/902,116, filed on Sep. 18, 2019, which is hereby incorporated by reference in its entirety.

BACKGROUND

Some known aircraft include integral fuel tanks in the otherwise-unused space inside of its wings. These fuel tanks may include thousands of fastener ends and hundreds of feet of seams and flanges. To reduce leakage from these fuel tanks, such features may be coated with a sealant material. Known methods for sealing such features are manually performed and require a substantial amount of time. For example, a caulking gun or spatula may be used to apply a sufficient amount of sealant material onto each fastener end, seam, and flange. In certain situations, at least some fastener ends have been covered by caps filled with the sealant material. However, this remains a labor-intensive, time-consuming task.

SUMMARY

Examples of the disclosure enable a plurality of features to be automatically coated with a sealant material. In one aspect, a nozzle is provided for applying a sealant to a target area that includes a coupling member and an elongated seam. The nozzle includes a primary portion positionable in line with the coupling member in the target area, a first secondary portion on a first side of the primary portion, and a second secondary portion on a second side of the primary portion. The primary portion is in fluid communication with one or more material sources. The first secondary portion extends from the primary portion such that the first secondary portion is configured to extend over at least a segment of the elongated seam in the target area when the primary portion is positioned in line with the coupling member in the target area. The first secondary portion has a first height, and the second secondary portion has a second height less than the first height.

In another aspect, a dispenser system is provided for applying sealant. The dispenser system includes a nozzle adaptor, and a nozzle coupleable to the nozzle adapter. The nozzle includes a primary portion, a first secondary portion on a first side of the primary portion, and a second secondary portion on a second side of the primary portion. The first secondary portion is configured to extend over at least a segment of an elongated seam in a target area when the primary portion is positioned in line with a coupling member in the target area. The first secondary portion has a first height, and the second secondary portion has a second height less than the first height.

In yet another aspect, a method is provided for applying sealant. The method includes identifying a target area that includes a coupling member and an elongated seam, and moving a nozzle toward the identified target area. The nozzle includes a primary portion, a first secondary portion on a first side of the primary portion, and a second secondary portion on a second side of the primary portion. The first secondary portion has a first height, and the second secondary portion has a second height less than the first height. The nozzle is aligned with the identified target area such that the primary portion is aligned with the coupling member and the first secondary portion extends over at least a segment of the elongated seam in the target area, and one or more sealant materials are dispensed from the nozzle to form a sealant layer at the identified target area.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
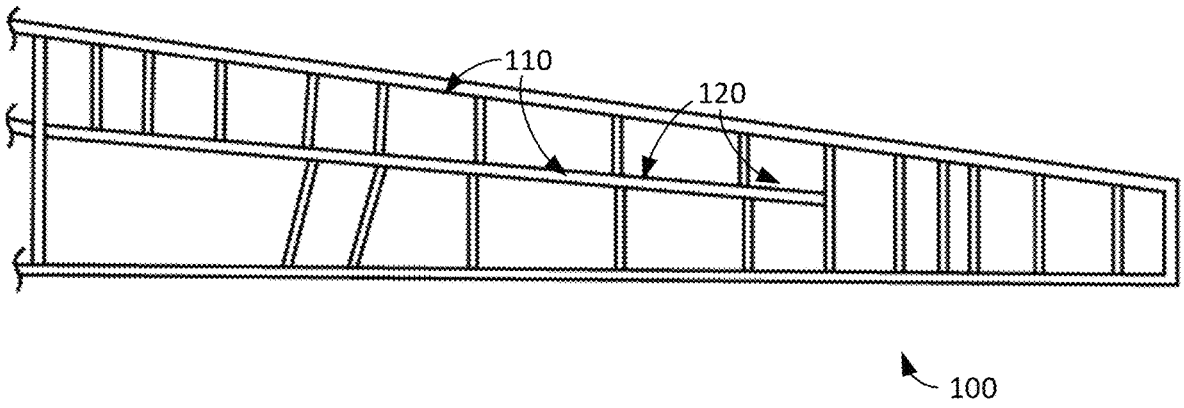
FIG. 1 includes a schematic plan view of an example aircraft wing.

Corresponding reference characters indicate corresponding parts throughout the drawings. Although specific features may be shown in some of the drawings and not in others, this is for convenience only. In accordance with the examples described herein, any feature of a drawing may be referenced and/or claimed in combination with any feature of any other drawing.

DETAILED DESCRIPTION

The present disclosure relates to sealing mechanisms and, more particularly, to methods and systems for applying sealant. Examples described herein include an application system that dispenses a sealant material onto a target area including one or more coupling members and an elongated seam. The application system includes a nozzle configured to overcoat the coupling members and create a fillet seal along the elongated seam. The coupling members may be overcoated and the fillet seal may be created, for example, in a single pass. While the examples described herein are described with respect to applying one or more sealant materials to fasteners of an aircraft fuel tank, one of ordinary skill in the art would understand and appreciate that the example systems and methods may be used to seal any surface or interface as described herein.

FIG. 1 shows an example aircraft wing 100 including a plurality of support members 110. The support members 110 form a skeletal shape for the aircraft wing 100. Example support members 110 may include, without limitation, spars, ribs, longerons, stiffeners, and/or stringers. One or more panel members 120 extend generally over and between upper ends of the support members 110, and under and between lower ends of the support members 110 to form a skin of the aircraft wing 100. In some examples, at least some support members 110 and/or panel members 120 are arranged to define a in which fuel may be held or stored.

Figure 2:
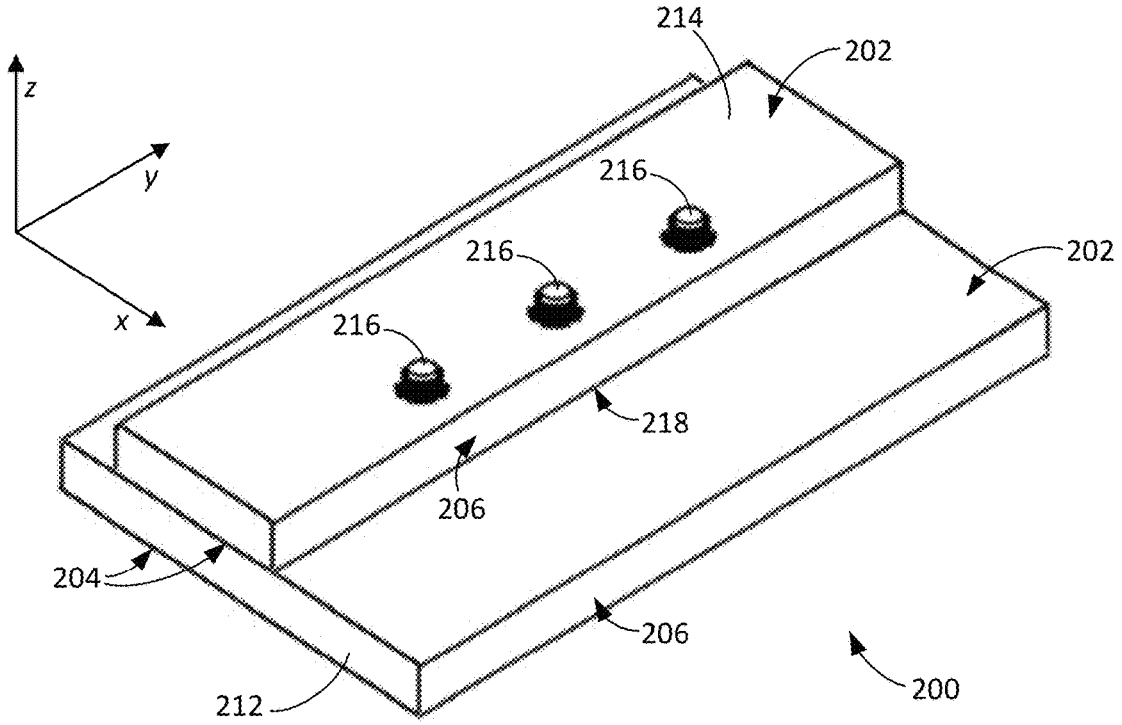
FIG. 2 includes a schematic perspective view of an example portion of the aircraft wing shown in FIG. 1 including a fillet.
Figure 3:
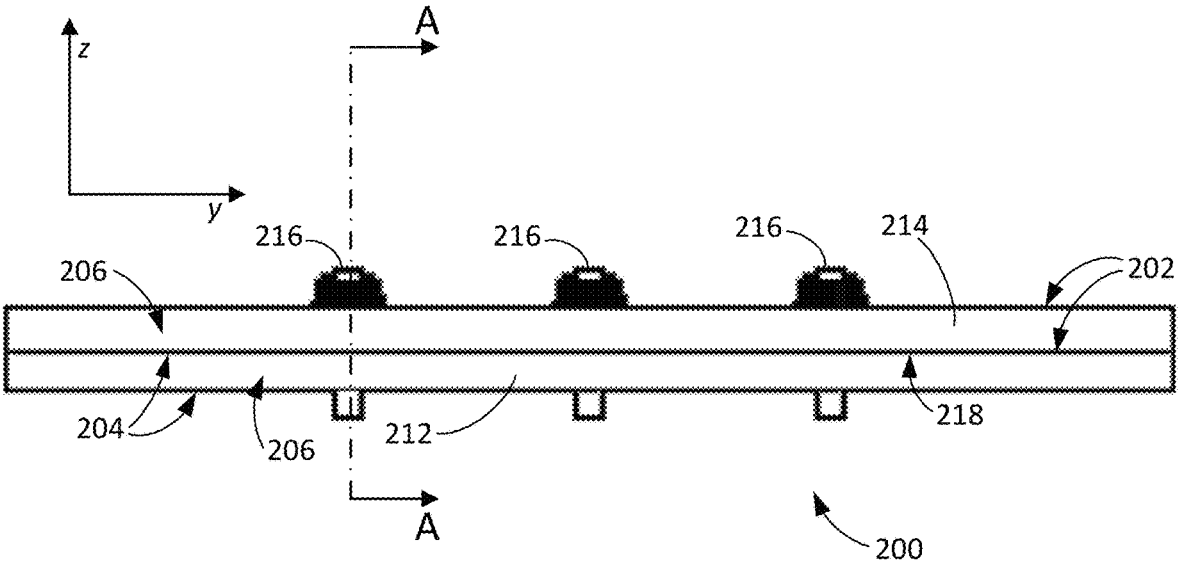
FIG. 3 includes a schematic side view of the aircraft wing portion shown in FIG. 2.

FIGS. 2 and 3 show a portion of the aircraft wing 100 (shown in FIG. 1) that includes a plurality of members 200 (e.g., support member 110, panel member 120). Each member 200 has a first surface 202 and an opposing second surface 204. The second surface 204 may be parallel or substantially parallel to the first surface 202. In some examples, one or more members 200 include at least one third surface 206 extending between the first surface 202 and second surface 204. The third surface 206 may be perpendicular or substantially perpendicular to the first surface 202 and/or second surface 204. The members 200 are oriented such that the first surfaces 202 face generally upwardly (e.g., toward a positive direction along the Z-axis) and the second surfaces 204 face generally downwardly (e.g., toward a negative direction along the Z-axis).

In the example shown in FIGS. 2 and 3, members 200 include a first member 212 and a second member 214 coupled to the first member 212. The first member 212 and second member 214 are securely coupled to each other using one or more coupling members 216. The coupling members 216 extend through openings defined in the first member 212 and in the second member 214. In some examples, the first member 212 and second member 214 are positioned such that the openings defined in the first member 212 and in the second member 214 are aligned with each other, allowing the coupling members 216 to be extended therethrough. Example coupling members 216 may include, without limitation, bolts, screws, rivets, rods, studs, and/or any other fasteners that enable the members 200 to be coupled to each other.

The first member 212 and second member 214 are coupled to each other such that one or more elongated seams 218 are formed therebetween. The second member 214 overlaps or extends over the first member 212 such that a second surface 204 of the second member 214 engages one area of the first surface 202 of the first member 212 while leaving another area of the first surface 202 of the first member 212 exposed. As shown in FIGS. 2 and 3, the elongated seams 218 are formed where the first surface 202 of the first member 212 and the third surface 206 of the second member 214 meet. Alternatively, the first member 212 and/or second member 214 may be arranged in any manner (e.g., at a tee joint, a lap joint, and/or a corner joint) that forms an elongated seam 218.

Figure 4:
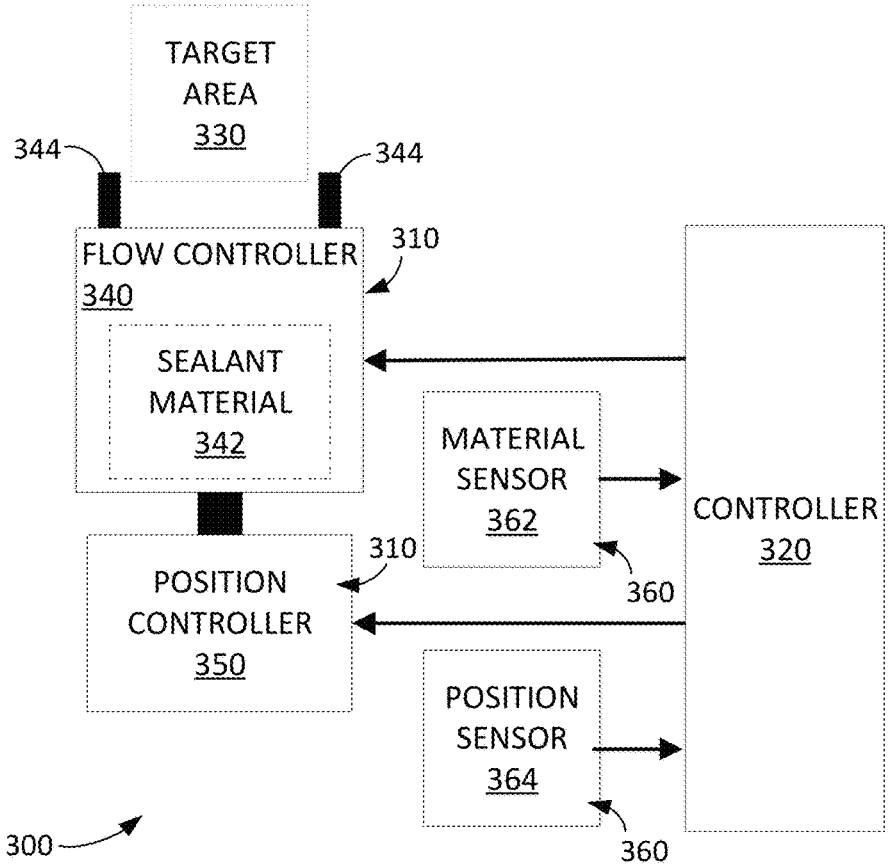
FIG. 4 includes a block diagram of an example application system for applying sealant.

FIG. 4 shows an example application system 300 including a plurality of control mechanisms 310 and a controller 320 that manages or controls the control mechanisms 310 to dispense one or more materials toward or onto one or more target areas 330. Example target areas 330 include, without limitation, one or more surfaces of one or more objects (e.g., first surface 202, second surface 204, and/or third surface 206 of first member 212 and/or second member 214). The control mechanisms 310 may be controlled, for example, to dispense materials for sealing one or more spaces or interfaces between a radially-inner surface defining an opening (e.g., openings defined in the first member 212 and/or in the second member 214) and a radially-outer surface of an extension member extending through the opening (e.g., a shaft of the coupling member 216). For another example, the control mechanisms 310 may be controlled to dispense materials for sealing one or more spaces or interfaces between a surface of one member (e.g., first surface 202 of first member 212) and a surface of another member (e.g., third surface 206 of second member 214).

The control mechanisms 310 include one or more first control mechanisms or flow controllers 340 that enable one or more materials to be dispensed in a desired manner (e.g., toward or onto target area 330) by controlling a flow of the materials. The flow controllers 340 may be configured to control, for example, a composition, viscosity, volume, pressure, flow path, and/or flow rate of one or more materials channeled through and/or dispensed from the flow controllers 340. Example flow controllers 340 include, without limitation, nozzles, hoses, tubes, fittings, switches, valves, agitators, mixers, strainers, tanks, reservoirs, cartridges, diaphragms, barrel pumps, shot meters, and/or proportioners.

In some examples, the flow controllers 340 channel and dispense one or more sealant materials 342. Example sealant materials 342 may include, without limitation, a two-part manganese dioxide cured polysulfide polymer, such as P/S 890® fuel tank sealant or PR-1776M™ fuel tank sealant, and/or any other material configured to overcoat a coupling member 216 and/or create a fillet seal along an elongated seam 218. ("P/S 890" and "PR-1776M" are trademarks of PRC-Desoto International, Inc., a subsidiary of PPG Industries, Inc.). As shown in FIG. 4, the flow controllers 340 include one or more sidewalls 344 configured to at least partially control or retain dispensed material. The sidewalls 344 that may be used, for example, to maintain material in a predetermined shape (e.g., at target area 330) after being dispensed from the flow controllers 340.

The control mechanisms 310 include one or more second control mechanisms or position controllers 350 that enable one or more materials to be dispensed in a desired manner (e.g., toward or onto target area 330) by controlling a position and/or movement of the flow controllers 340. The position controllers 350 may be configured to control, for example, a location, orientation, speed, and/or direction of one or more flow controllers 340. In some examples, the position controllers 350 move the flow controllers 340 in a plurality of directions with multiple degrees of freedom. Example position controllers 350 include, without limitation, a robotic arm, electric motor, servo motor, step motor, hydraulic actuator, pneumatic actuator, and/or spring.

The controller 320 is configured to identify one or more target areas 330 and dispense one or more materials toward or onto the target areas 330 using the control mechanisms 310. In some examples, the controller 320 actuates the position controllers 350 to position and/or move the flow controllers 340 toward the target area 330 and/or actuate the flow controllers 340 to channel and/or dispense the materials (e.g., sealant material 342) toward the target areas 330. The application system 300 may include one or more sensors 360 at or proximate the control mechanisms 310 and/or target areas 330 to provide the controller 320 with information or feedback (e.g., a control signal) for actuating the control mechanisms 310. Feedback provided by the sensors 360 may be used to channel and/or dispense materials toward the target areas 330 in a desired manner.

In some examples, the sensors 360 include one or more material sensors 362 at or proximate the flow controllers 340 and/or target areas 330 to selectively adjust a flow of one or more materials channeled through and/or dispensed from the flow controllers 340. The material sensors 362 may be used to monitor the flow controllers 340 and/or target areas 330 and detect or identify one or more parameters associated with a state of the materials (e.g., volume, shape, coverage) and/or one or more flow paths of the materials (e.g., composition, viscosity, volume, pressure, flow rate). Example material sensors 362 may include, without limitation, flow meters, pressure sensors, force sensors, torque sensors, fluid composition sensors, optical sensors, acoustic sensors, and/or any other sensor that allow the controller 320 to identify the parameters described herein.

In some examples, the sensors 360 include one or more position sensors 364 at or proximate the position controllers 350 and/or target areas 330 to selectively adjust a position, orientation, speed, and/or direction of the flow controllers 340. The position sensors 364 may be used to monitor the flow controllers 340 and/or target areas 330 and detect or identify one or more parameters associated with a state of the flow controllers 340 (e.g., position, orientation, movement) and/or target areas 330 (e.g., position, orientation, movement, size, shape, coverage). Example position sensors 364 may include, without limitation, optical sensors, acoustic sensors, and/or any other sensor that allow the controller 320 to identify the parameters described herein.

Figure 5:
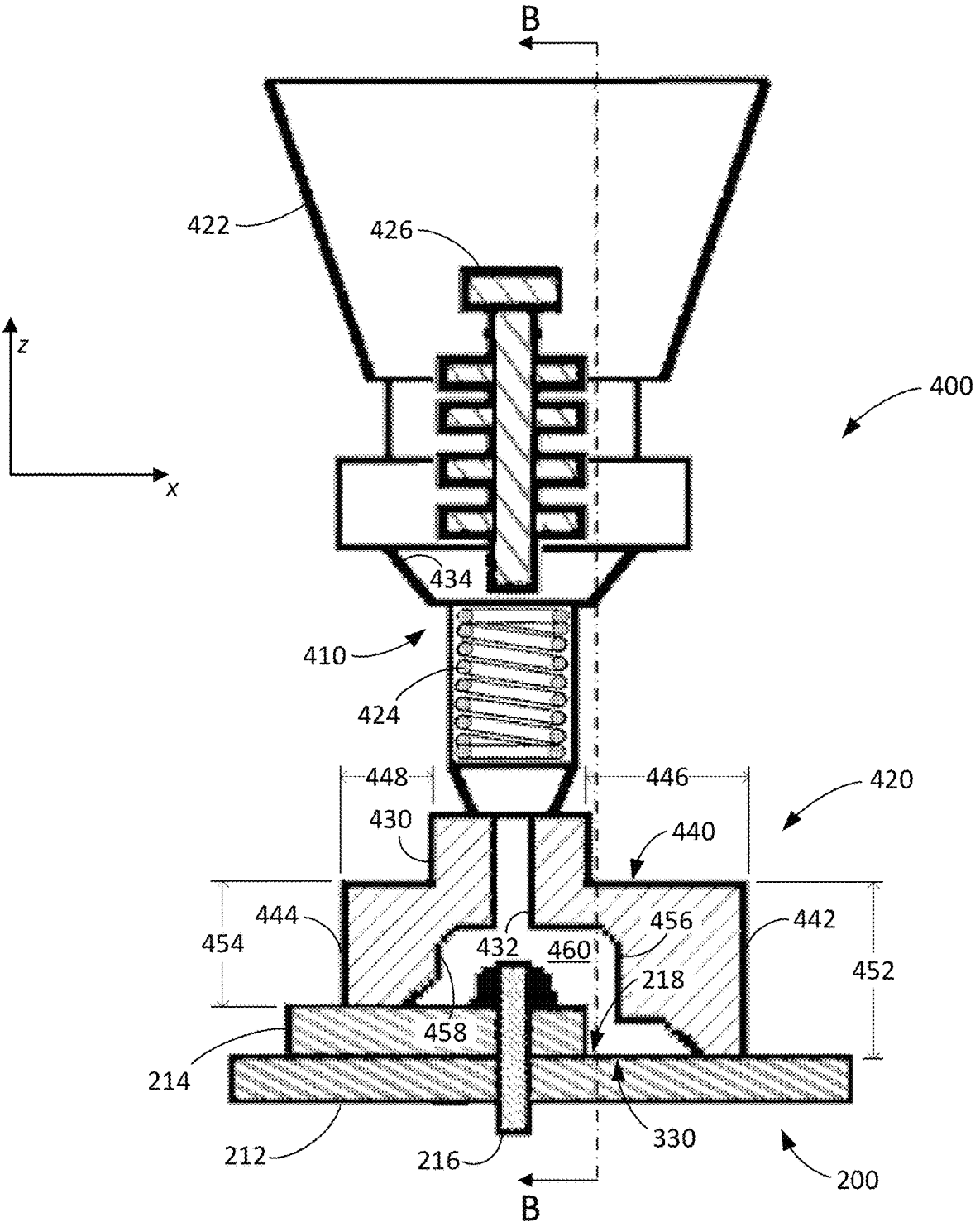
FIG. 5 includes a schematic partial cross-section view of the aircraft wing portion shown in FIG. 2 and an example dispenser system that may be used with an application system, such as the application system shown in FIG. 4.

FIG. 5 includes a cross-sectional end view of the members 200 (e.g., taken along line A-A shown in FIG. 3) and an example dispenser system 400 (e.g., flow controller 340) in a first state, prior to dispensing any materials (e.g., sealant material 342). The dispenser system 400 includes a nozzle adaptor 410 and a nozzle 420 coupled to the nozzle adaptor 410 (e.g., a "first nozzle"). In some examples, a plurality of nozzles 420 are coupleable to the nozzle adaptor 410 (e.g., for use in a variety of processes and/or applications). The nozzle 420 may be coupled to the nozzle adaptor 410 such that the nozzle 420 is generally in line with the nozzle adaptor 410 (e.g., along the Z-axis). As shown in FIG. 5, the nozzle 420 has a first longitudinal axis, and the nozzle adaptor 410 has a second longitudinal axis that is parallel or substantially parallel to the first longitudinal axis. In some examples, the dispenser system 400 allows a position and/or orientation of the nozzle adaptor 410 and/or nozzle 420 to be selectively adjusted.

As shown in FIG. 5, the nozzle adaptor 410 includes one or more coupling elements 422 (e.g., retaining nut) configured to couple the dispenser system 400 to one or more position controllers 350 (shown in FIG. 4). The coupling elements 422 have or include one or more locating features (e.g., notch, pin) that enable the nozzle 420 to be positioned and/or oriented in a desired manner relative to the position controllers 350 and/or nozzle adaptor 410, as further described below. In some examples, the nozzle adaptor 410 includes one or more biasing elements 424 (e.g., compression spring) configured to absorb or mitigate at least some force applied by the nozzle 420 (e.g., onto another object). For example, when the nozzle 420 is moved downwards (e.g., in a negative direction along the Z-axis) to engage an object, the biasing elements 424 may be urged upwards (e.g., in a positive direction along the Z-axis) to generate a counterforce, decreasing the force conveyed to the other object. Alternatively, the nozzle adaptor 410 may be rigid or inflexible in order to facilitate precise control and positioning of the nozzle 420 (e.g., with respect to the target areas 330).

The nozzle 420 is configured to dispense materials for overcoating coupling members 216 and/or creating fillet seals along elongated seams 218 (e.g., at one or more target areas 330). The nozzle 420 is coupled in fluid communication with one or more material sources (not shown) via the nozzle adaptor 410. In some examples, the nozzle adaptor 410 includes a mixing element 426 that mixes one or more materials prior to dispensing. The nozzle 420 includes a core or primary portion 430 having an inner surface 432 that defines a nozzle inlet channel, and the nozzle adaptor 410 has an inner surface 434 defining an adaptor outlet channel in fluid communication with the nozzle inlet channel.

The nozzle 420 is sized, shaped, and/or configured to span one or more target areas 330. The target area 330 may include, for example, one or more coupling members 216 and/or a portion or segment of an elongated seam 218 adjacent the coupling members 216. As shown in FIG. 5, the primary portion 430 may extend between a plurality of secondary portions 440 including a first secondary portion 442 on a first side of the primary portion 430 and a second secondary portion 444 on a second side of the primary portion 430. In some examples, the second side of the primary portion 430 is opposite the first side of the primary portion 430. For example, as shown in FIG. 5, the first secondary portion 442 extends from the primary portion 430 in a first direction (e.g., a positive direction along the X-axis), and the second secondary portion 444 extends from the primary portion 430 in a second direction opposite the first direction (e.g., a negative direction along the X-axis). In some examples, the first secondary portion 442 extends laterally (e.g., along the X-axis) from the primary portion 430 a first width 446, and the second secondary portion 444 extends laterally (e.g., along the X-axis) from the primary portion 430 a second width 448 less than the first width 446.

The secondary portions 440 are configured to engage one or more surfaces in the target area 330 such that the primary portion 430 is spaced (e.g., with respect to the Z-axis) from the surfaces in the target area 330. For example, as shown in FIG. 5, the first secondary portion 442 engages an area or portion of the members 200 adjacent and on a first side of the coupling members 216 (e.g., first surface 202 of first member 212), and the second secondary portion 444 engages an area or portion of the members 200 adjacent and on a second side of the coupling members 216 (e.g., first surface 202 of second member 214). In some examples, the first secondary portion 442 has a first height 452, and the second secondary portion 444 has a second height 454 less than the first height 452. In this manner, the first secondary portion 442 may be configured to engage the first surface 202 of the first member 212 at a first elevation, and the second secondary portion 444 may be configured to engage the first surface 202 of the second member 214 at a second elevation higher (e.g., with respect to the Z-axis) than the first elevation.

The first secondary portion 442 and second secondary portion 444 include a first inner surface 456 and a second inner surface 458, respectively, defining a cavity 460 sized, shaped, and/or configured to channel materials for overcoating a coupling member 216 and creating a fillet seal along a segment of elongated seam 218 adjacent the coupling member 216 in a single pass. A lower portion of the cavity 460 (e.g., with respect to the Z-axis) has a larger width than an upper portion of the cavity 460. For example, as shown in FIG. 5, the first inner surface 456 and second inner surface 458 slope generally in opposite directions such that a width of the cavity generally increases as the first inner surface 456 and second inner surface 458 extend away from the primary portion 430.

As shown in FIG. 5, the nozzle 420 may be positioned such that the primary portion 430 is generally in line with a coupling member 216 (e.g., with respect to the X-axis and/or Y-axis) and extends over an area or portion of the members 200 adjacent the coupling member 216, the first inner surface 456 extends over an area or portion of the members 200 adjacent the coupling member 216 on a first side of the coupling member 216, and the second inner surface 458 extends over an area or portion of the members 200 adjacent the coupling member 216 on a second side of the coupling member 216.

Figure 6:
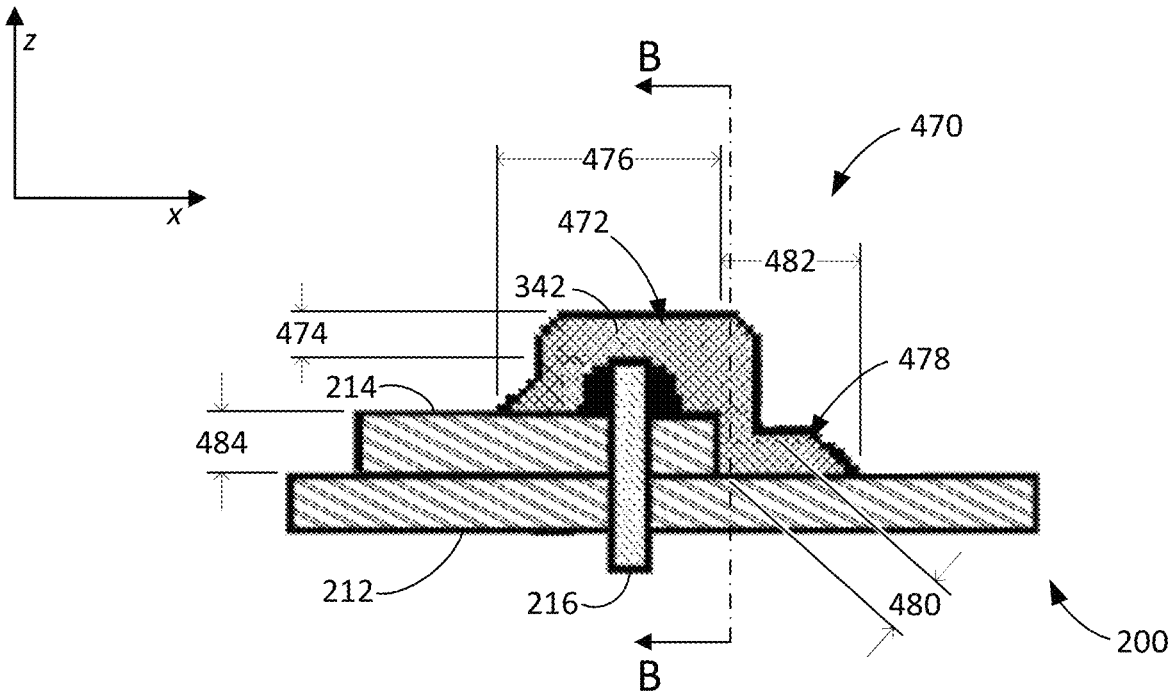
FIG. 6 includes a schematic cross-section view of the aircraft wing portion shown in FIG. 2 including an example fillet seal that may be formed using a dispenser system, such as the dispenser system shown in FIG. 5.

FIG. 6 includes a cross-sectional end view of the members 200 (e.g., taken along line A-A shown in FIG. 3) in a second state, after dispensing sealant materials 342 and extracting the dispenser system 400. The sealant materials 342 create or form a seal 470 at a target area 330. In some examples, the nozzle 420 is sized, shaped, and/or configured to form a seal 470 including an overcoat portion 472 that overcoats the members 200 and coupling members 216. The overcoat portion 472 may have a thickness 474 (shown in FIG. 6) (e.g., measured from an upper end of the coupling member 216) of at least approximately 0.10 inches (in.) and/or a width 476 (e.g., shown in FIG. 6) (e.g., measured from an edge of the first surface 202 of the second member 214) of at least approximately 0.15 in.

Additionally, the seal 470 is formed to include a fillet portion 478 (shown in FIG. 6) that seals one or more elongated seams 218 between the members 200. The fillet portion 478 may have a thickness 480 (shown in FIG. 6) (e.g., measured from the elongated seam 218) of at least approximately 0.15 in., a width 482 (shown in FIG. 6) (e.g., measured from the third surface 206 of the second member 214) of at least approximately 0.25 in., and/or a height 484 (shown in FIG. 6) (e.g., measured from the first surface 202 of the first member 212) of at least approximately 0.15 in. In some examples, the height 484 of the fillet portion 478 is the same as or is substantially similar to a height of the second member 214. For example, the fillet portion 478 (and second member 214) may have a height 484 of less than approximately 0.25 in. For another example, the fillet portion 478 (and second member 214) may have a height 484 of 0.25-0.50 in., inclusive.

Figure 7:
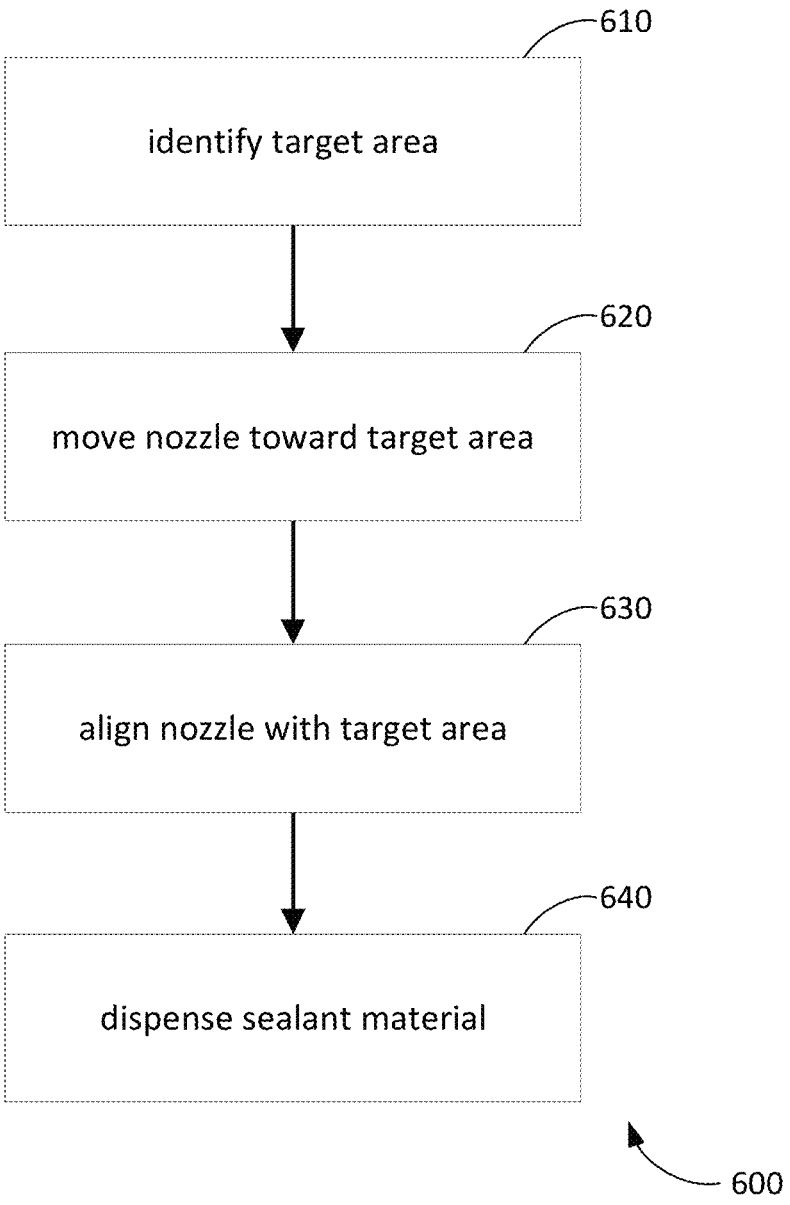
FIG. 7 includes a flowchart of an example method of applying sealant using an application system, such as the application system shown in FIG. 4.

FIG. 7 shows an example method 600 of applying sealant. The application system 300 (shown in FIG. 4), for example, may be used to perform one or more operations of the method 600 for sealing one or more fillets (e.g., at one or more target areas 330). The method 600 may be implemented to prevent fuel from leaking or seeping through or around one or more components (e.g., support member 110, panel member 120, member 200, first member 212, second member 214, coupling member 216). FIGS. 8-11 include cross-sectional side views of the members 200 and the dispenser system 400 (e.g., taken along line B-B shown in FIGS. 5 and 6) at various stages of the method 600.

A target area 330 is identified at operation 610. The target area 330 may include, for example, an elongated seam 218, a coupling member 216, and/or an area or portion of one or more members 200 adjacent the elongated seam 218 and/or coupling member 216. A location of the target area 330 may be predetermined or determined based on known locations (e.g., a relative location). In some examples, the location of the target area 330 is determined based on one or more parameters detected or identified using one or more position sensors 364.

Figure 8:
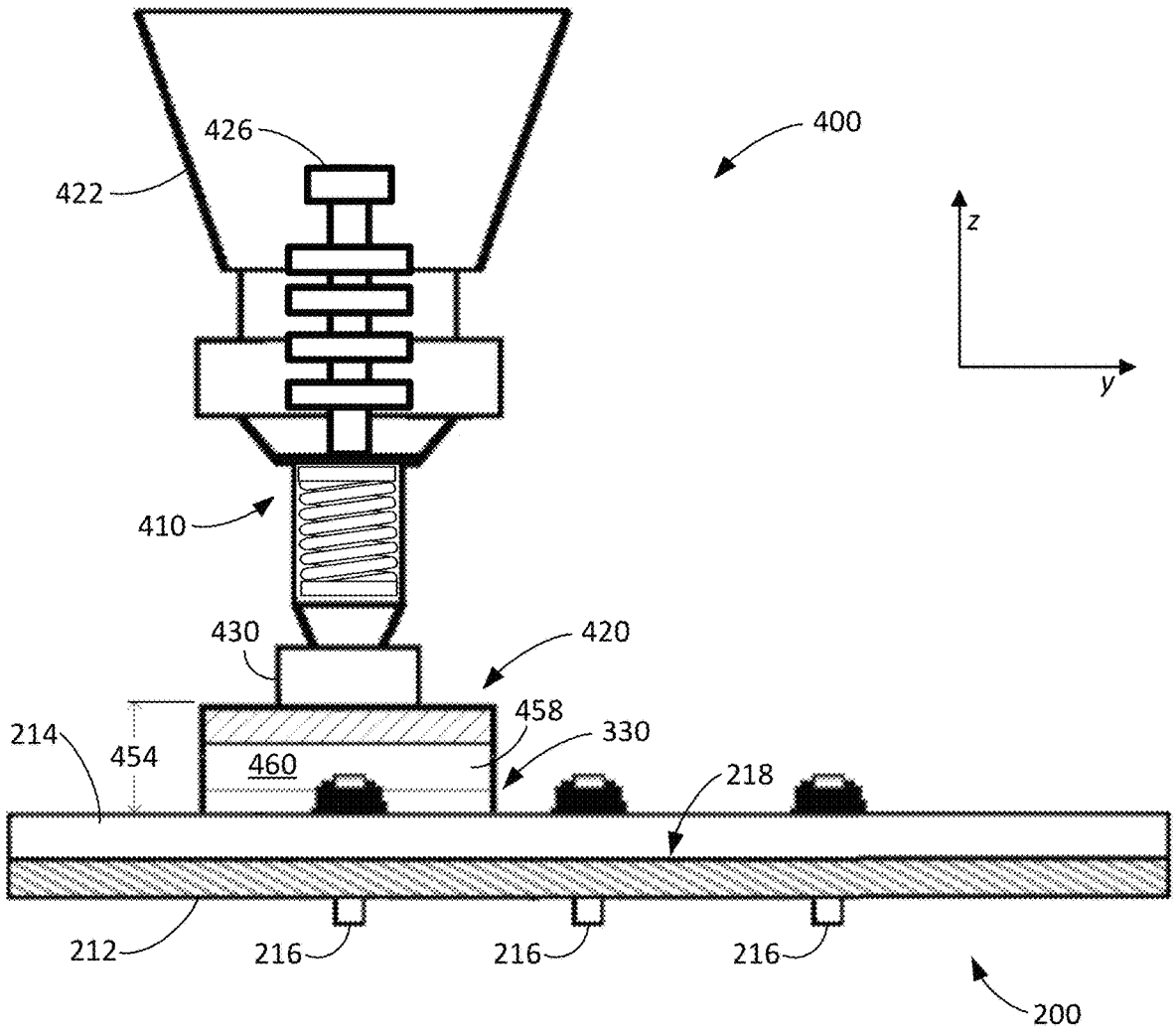
FIGS. 8-11 include schematic cross-section views of the aircraft wing portion shown in FIG. 2 and the dispenser system shown in FIG. 5 at various stages of the method shown in FIG. 7.

A nozzle (e.g., nozzle 420) is moved toward the identified target area 330 at operation 620. In some examples, the nozzle 420 and/or any other flow controllers 340 may be selected based on a size, shape, and/or configuration of the target area 330, one or more objects in the target area 330 (e.g., members 200, coupling member 216), and/or desired seal (e.g., seal 470). At operation 630, the nozzle 420 is aligned with the identified target area 330. The nozzle 420 may be moved, for example, to extend over a first coupling member 216 in a line or series of coupling members 216 and/or a first portion or segment of the elongated seam 218 and then moved downwards (e.g., in a negative direction along the Z-axis) towards the first coupling member 216 and/or first segment of the elongated seam 218. In some examples, the nozzle 420 is aligned such that the first secondary portion 442 engages a first portion of the target area 330 (e.g., first surface 202 of first member 212) on one side of the first coupling member 216 and the second secondary portion 444 engages a second portion of the target area (e.g., first surface 202 of second member 214) on another side of the first coupling member 216. Additionally, the primary portion 430 may be aligned with the first coupling member 216. FIG. 8 includes a cross-sectional side view of the members 200 and the dispenser system 400 in a first state, prior to dispensing any materials (e.g., sealant material 342).

Figure 9:
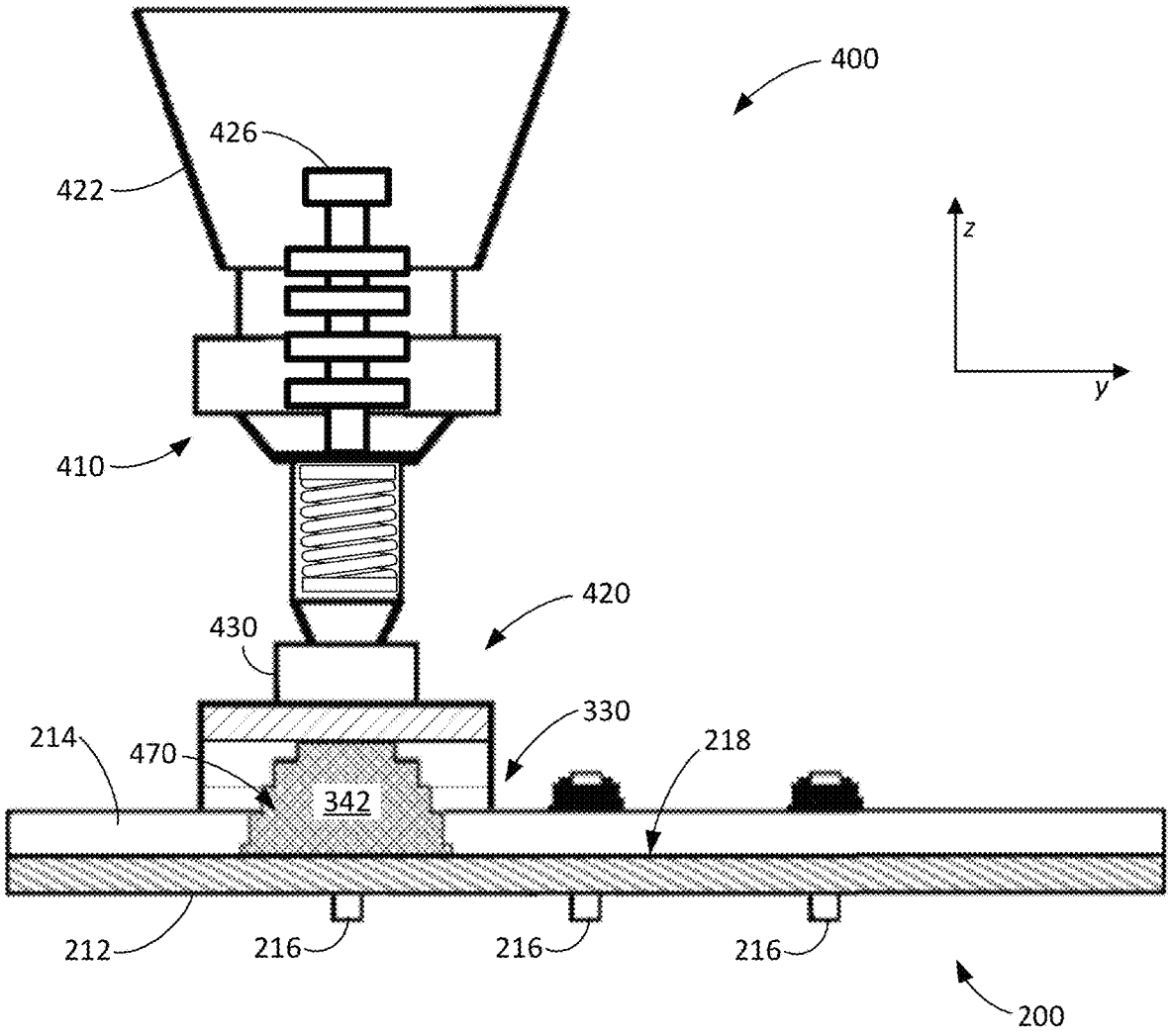

One or more sealant materials 342 are dispensed from the nozzle 420 at operation 640 to form a sealant layer (e.g., seal 470) over the first coupling member 216 and/or first portion or segment of the elongated seam 218. Sealant materials 342 may be channeled from a sealant source (e.g., material source) using one or more flow controllers 340. The nozzle 420 may dispense, for example, approximately 1.5 cubic centimeters (cc) of sealant material 342 per second, which is approximately 0.05 fluid ounces per second, for a predetermined length of time. FIG. 9 shows the target area 330 after dispensing sealant material 342 onto the first coupling member 216 and/or first segment of the elongated seam 218.

Figure 10:
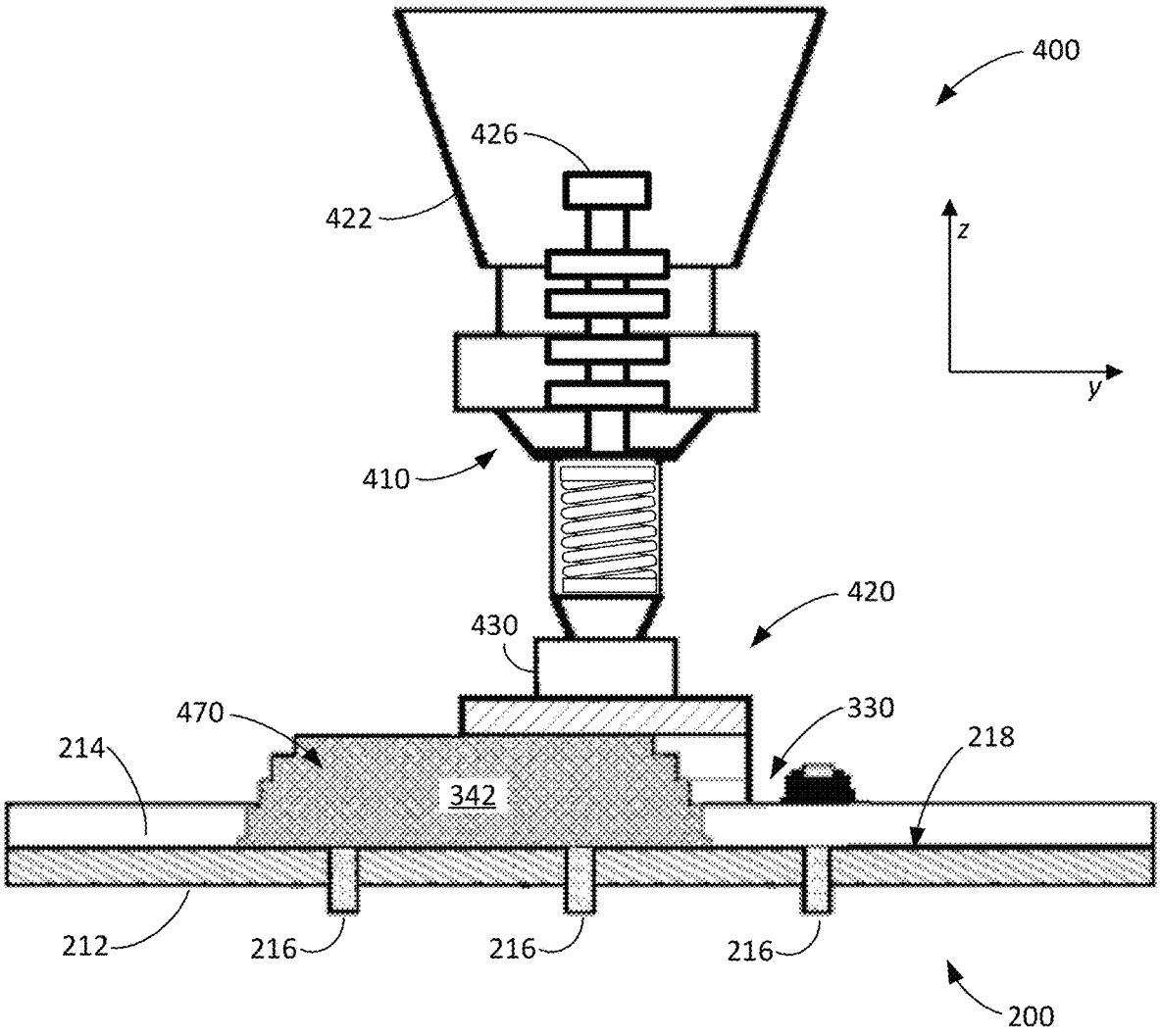
Figure 11:
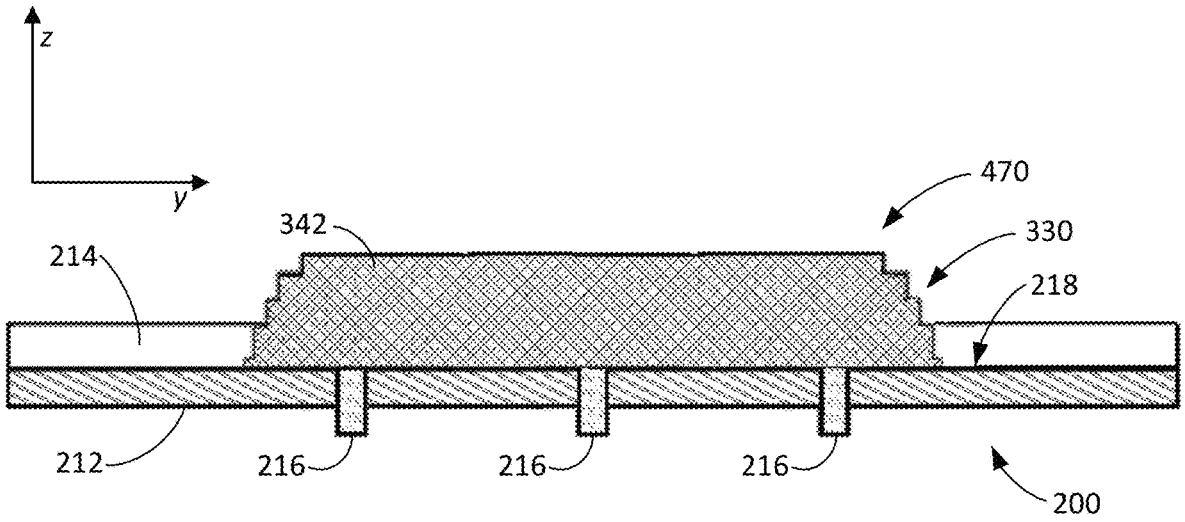

The seal 470 is formed to cover or encapsulate the coupling members 216 and/or elongated seam 218. To create or form an overcoat and fillet seal for each coupling member 216 in the series of coupling members 216 and/or segment of the elongated seam 218, the seal 470 may be formed by using one or more flow controllers 340 (e.g., nozzle 420) to dispense sealant material 342 while one or more position controllers 350 slide or move the flow controllers 340 generally along or parallel to the coupling members 216 and/or elongated seam 218. Sealant material 342 may be dispensed while moving generally along or parallel to the coupling members 216 and/or elongated seam 218 at a speed of approximately 50 millimeters (mm) per second, which is approximately 1.97 in. per second. In some examples, the nozzle 420 is moved (e.g., in a positive direction along the Y-axis) toward the next coupling member 216 in the series of coupling members 216 and/or next segment of the elongated seam 218 until the seal 470 is formed over each coupling member 216 in the series of coupling members 216 and/or segment of the elongated seam 218. FIG. 10 shows the target area 330 after dispensing sealant material 342 onto the second coupling member 216 and/or second segment of the elongated seam 218 and before dispensing sealant material 342 onto the last coupling member 216 and/or last segment of the elongated seam 218.

After dispensing sealant material 342 onto the last coupling member 216 in the series of coupling members 216 and/or last segment of the elongated seam 218, the nozzle 420 stops dispensing sealant material 342 and is moved upwards (e.g., in a positive direction along the Z-axis) away from the last coupling member 216 and/or last segment of the elongated seam 218 such that the first secondary portion 442 disengages the first surface 202 of the first member 212 and the second secondary portion 444 disengages the first surface 202 of the second member 214. The nozzle 420 may be moved away from the target area 330 in a sweeping motion, for example. In some examples, the dispenser system 400 forms a seal 470 that satisfies one or more predetermined coverage requirements in a single pass. The seal 470 may be formed to have a thickness (e.g., measured from the members 200 and/or coupling member 216) of at least approximately 0.15 in., for example FIG. 11 includes a cross-sectional side view of the members 200 in a second state, after dispensing any materials and extracting the dispenser system 400.

During implementation, the flow controllers 340 and/or position controllers 350 may be adjusted based on feedback from one or more sensors 360 (e.g., material sensor 362, position sensor 364). Sensors 360 may be used, for example, to determine and/or identify whether sealant material 342 is dispensed in one or more desired amounts, the nozzle 420 is in a desired position, and/or the seal 470 has a desired size and/or shape.

Figure 12:
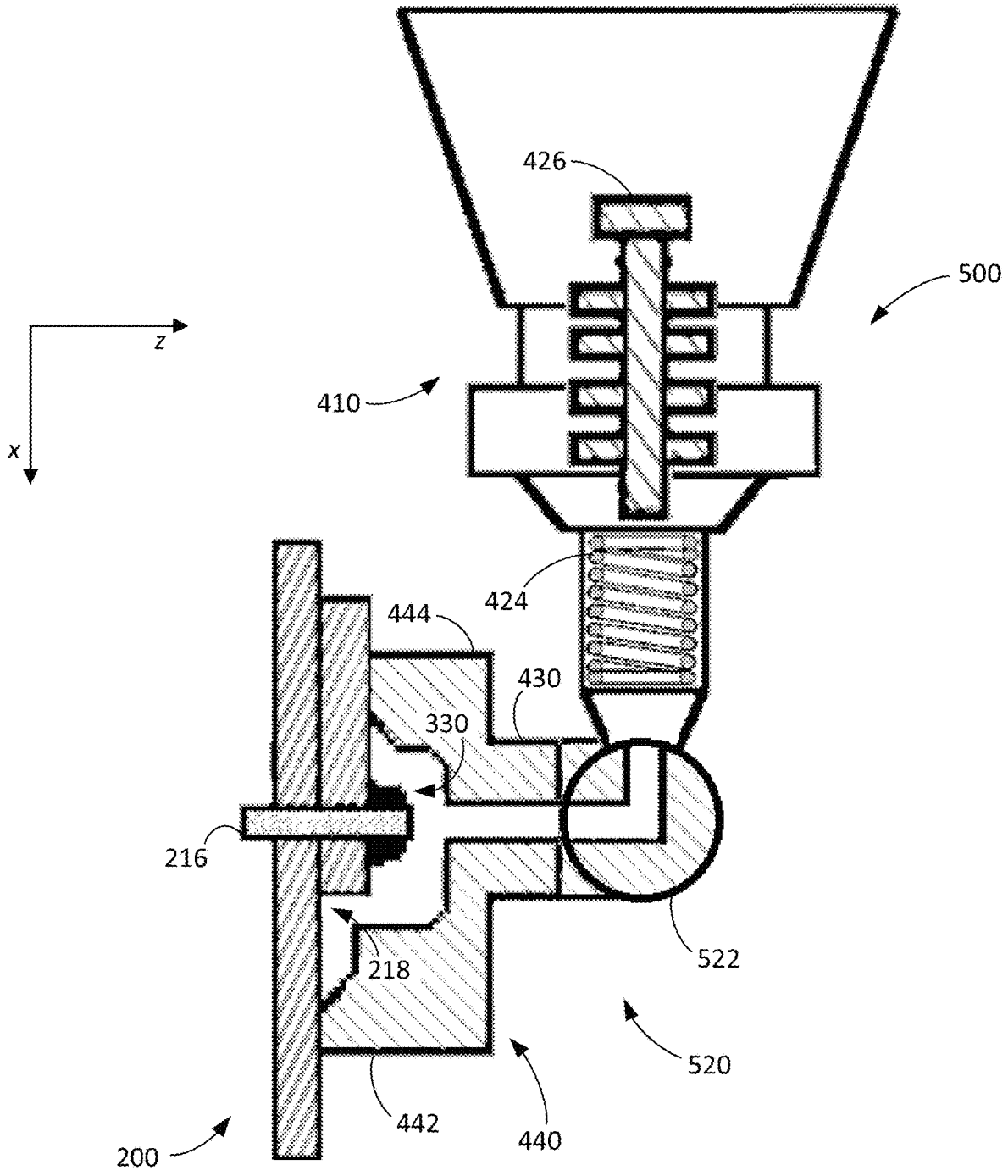
FIG. 12 includes a schematic partial cross-section view of the aircraft wing portion shown in FIG. 2 and another example dispenser system that may be used with an application system, such as the application system shown in FIG. 4.

FIG. 12 shows the members 200 and another example dispenser system 500 (e.g., flow controller 340) that may be used to seal one or more fillets (e.g., using method 600). FIG. 12 includes a cross-sectional end view (e.g., taken along line A-A shown in FIG. 3). The dispenser system 500 is substantially similar to the dispenser system 400, with at least some distinctions described below.

The dispenser system 500 includes a nozzle 520 (e.g., a "second nozzle") sized, shaped, and/or configured to dispense one or more materials toward or onto a target area 330 that includes at least one coupling member 216 and a portion or segment of an elongated seam 218. Like the nozzle 420, the nozzle 520 may be coupled to the nozzle adaptor 410 (e.g., for dispensing one or more materials) and include a primary portion 430, a first secondary portion 442 on a first side of the primary portion 430, and a second secondary portion 444 on a second side of the primary portion 430.

In some examples, the nozzle 520 includes a wrist 522 that couples the nozzle 520 to the nozzle adaptor 410. The wrist 522 defines one or more channels therethrough to couple the nozzle inlet channel in fluid communication with the adaptor outlet channel. Alternatively, the wrist 522 may be included in the nozzle adaptor 410. For example, one or more biasing elements 424 and/or mixing elements 426 may be positioned upstream of the wrist 522 (i.e., between the wrist 522 and the material source), as shown in FIG. 12, and/or downstream of the wrist 522 (i.e., between the wrist 522 and the nozzle 520).

The wrist 522 includes one or more links or joints that allow a position and/or orientation of the nozzle 520 to be selectively adjusted (e.g., for traversing or accessing one or more target areas 330 and/or for engaging one or more surfaces in the target area 330). For example, the wrist 522 may allow the nozzle 520 to translate (e.g., along the X-axis, Y-axis, and/or Z-axis) and/or rotate (e.g., roll, pitch, and/or yaw). As shown in FIG. 12, the nozzle 520 has a first longitudinal axis, and the nozzle adaptor 410 has a second longitudinal axis that is perpendicular or substantially perpendicular to the first longitudinal axis. Alternatively, the nozzle adaptor 410 and/or nozzle may be positioned and/or oriented in any direction that enables the dispenser system 500 to function as described herein.

Figure 13:
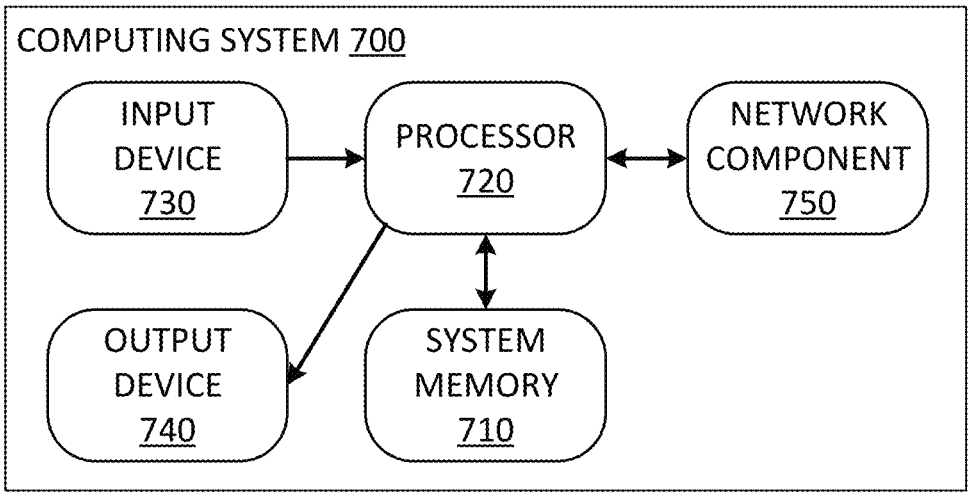
FIG. 13 includes a block diagram of an example computing system that may be used to operate an application system, such as the application system shown in FIG. 4.

FIG. 13 shows an example computing system 700 configured to perform one or more computing operations. While some examples of the disclosure are illustrated and described herein with reference to the computing system 700 being included in a controller 320 (shown in FIG. 4), aspects of the disclosure are operable with any computing system (e.g., control mechanisms 310, flow controllers 340, position controllers 350, sensors 360, material sensors 362, position sensors 364) that executes instructions to implement the operations and functionality associated with the computing system 700. The computing system 700 shows only one example of a computing environment for performing one or more computing operations and is not intended to suggest any limitation as to the scope of use or functionality of the disclosure.

In some examples, the computing system 700 includes a system memory 710 (e.g., computer storage media) and a processor 720 coupled to the system memory 710. Although the processor 720 is shown separate from the system memory 710, examples of the disclosure contemplate that the system memory 710 may be onboard the processor 720, such as in some embedded systems. The system memory 710 stores data associated with the application system 300 and computer-executable instructions, and the processor 720 is programmed or configured to execute the computer-executable instructions for implementing aspects of the disclosure using the application system 300. For example, at least some data may be associated with one or more target areas 330, one or more control mechanisms 310 (e.g., flow controllers 340, position controllers 350), one or more sealant materials 342, and/or one or more sensors 360 (e.g., material sensors 362, position sensors 364) such that the computer-executable instructions enable the processor 720 to manage or control one or more operations of a dispenser including the flow controllers 340 and/or material sensors 362, and/or one or more operations of a robot including the position controllers 350 and/or position sensors 364.

In some examples, the processor 720 executes the computer-executable instructions to identify a target area 330, move a nozzle (e.g., nozzle 420, nozzle 520) toward the identified target area 330, align the nozzle with the identified target area 330, and/or dispense one or more sealant materials 342 from the nozzle to form a sealant layer (e.g., seal 470) at the identified target area 330. The processor 720 may include one or more processing units (e.g., in a multi-core configuration). A state of the application system 300 may be monitored (e.g., using one or more sensors 360), and one or more control mechanisms 310 may be adjusted based on the monitoring.

The system memory 710 includes one or more computer-readable media that allow information, such as the computer-executable instructions and other data, to be stored and/or retrieved by the processor 720. By way of example, and not limitation, computer-readable media may include computer storage media and communication media. Computer storage media are tangible and mutually exclusive to communication media. For example, the system memory 710 may include computer storage media in the form of volatile and/or nonvolatile memory, such as read only memory (ROM) or random access memory (RAM), electrically erasable programmable read-only memory (EEPROM), solid-state storage (SSS), flash memory, a hard disk, a floppy disk, a compact disc (CD), a digital versatile disc (DVD), magnetic tape, or any other medium that may be used to store desired information that may be accessed by the processor 720. Computer storage media are implemented in hardware and exclude carrier waves and propagated signals. That is, computer storage media for purposes of this disclosure are not signals per se.

A user or operator may enter commands and other input into the computing system 700 through one or more input devices 730 (e.g., sensors 360) coupled to the processor 720. The input devices 730 are configured to receive information (e.g., from the user). Example input device 730 include, without limitation, a pointing device (e.g., mouse, trackball, touch pad, joystick), a keyboard, a game pad, a controller, a microphone, a camera, a gyroscope, an accelerometer, a position detector, and an electronic digitizer (e.g., on a touchscreen). Information, such as text, images, video, audio, and the like, may be presented to a user via one or more output devices 740 coupled to the processor 720. The output devices 740 are configured to convey information (e.g., to the user). Example, output devices 740 include, without limitation, a monitor, a projector, a printer, a speaker, a vibrating component. In some examples, an output device 740 is integrated with an input device 730 (e.g., a capacitive touch-screen panel, a controller including a vibrating component).

One or more network components 750 may be used to operate the computing system 700 in a networked environment using one or more logical connections. Logical connections include, for example, local area networks and wide area networks (e.g., the Internet). The network components 750 allow the processor 720, for example, to convey information to and/or receive information from one or more remote devices, such as another computing system or one or more remote computer storage media. Network components 750 may include a network adapter, such as a wired or wireless network adapter or a wireless data transceiver.

Example sealing mechanisms are described herein and illustrated in the accompanying drawings. An automated application system is used to apply a layer of sealant material at a target area in a single pass. The application system includes a nozzle that defines a cavity sized and shaped to have enough space between the nozzle and objects in the target area to allow a robust seal satisfying one or more coverage requirements to be created. The seal may be formed, for example, to fill or cover spaces or interfaces between surfaces in the target area and have or exceed a predetermined thickness.

The examples described herein enable many features to be automatically coated with a sealant material in a quick, efficient, and user-friendly manner With the sheer number of fasteners, seams, and/or flanges in an aircraft, for example, automatically applying sealant material using the examples described herein may save hundreds of man-hours per aircraft. Moreover, the examples described herein allow the sealant material to be consistently applied within specifications, potentially saving thousands of dollars in material cost and waste reduction. This written description uses examples to disclose aspects of the disclosure and also to enable a person skilled in the art to practice the aspects, including making or using the above-described systems and executing or performing the above-described methods.

Having described aspects of the disclosure in terms of various examples with their associated operations, it will be apparent that modifications and variations are possible without departing from the scope of the disclosure as defined in the appended claims. That is, aspects of the disclosure are not limited to the specific examples described herein, and all matter contained in the above description and shown in the accompanying drawings shall be interpreted as illustrative and not in a limiting sense. For example, the examples described herein may be implemented and utilized in connection with many other applications such as, but not limited to, safety equipment.

Components of the systems and/or operations of the methods described herein may be utilized independently and separately from other components and/or operations described herein. Moreover, the methods described herein may include additional or fewer operations than those disclosed, and the order of execution or performance of the operations described herein is not essential unless otherwise specified. That is, the operations may be executed or performed in any order, unless otherwise specified, and it is contemplated that executing or performing a particular operation before, contemporaneously with, or after another operation is within the scope of the disclosure. Although specific features of various examples of the disclosure may be shown in some drawings and not in others, this is for convenience only. In accordance with the principles of the disclosure, any feature of a drawing may be referenced and/or claimed in combination with any feature of any other drawing.

When introducing elements of the disclosure or the examples thereof, the articles "a," "an," "the," and "said" are intended to mean that there are one or more of the elements. References to an "embodiment" or an "example" of the present disclosure are not intended to be interpreted as excluding the existence of additional embodiments or examples that also incorporate the recited features. The terms "comprising," "including," and "having" are intended to be inclusive and mean that there may be elements other than the listed elements. The phrase "one or more of the following: A, B, and C" means "at least one of A and/or at least one of B and/or at least one of C."

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dispenser system for applying sealant, the dispenser system comprising:

a nozzle adaptor defining an adaptor outlet channel;

a nozzle defining a nozzle inlet channel, the nozzle including a primary portion, a first secondary portion on a first side of the primary portion, and a second secondary portion on a second side of the primary portion, wherein the first secondary portion is configured to extend over at least a segment of an elongated seam in a target area when the primary portion is positioned in line with a coupling member in the target area, and wherein the first secondary portion has a first height and the second secondary portion has a second height less than the first height; and a wrist configured to selectively adjust an orientation of the nozzle, the wrist defining a channel therethrough to couple the nozzle inlet channel in fluid communication with the adaptor outlet channel.

2. The dispenser system of claim 1, wherein the first secondary portion is configured to engage a first surface in the target area at a first elevation and the second secondary portion is configured to engage a second surface in the target area at a second elevation higher than the first elevation.

3. The dispenser system of claim 1, wherein the primary portion is configured to be spaced from a surface in the target area when the first secondary portion engages a first surface in the target area and the second secondary portion engages a second surface in the target area.

4. The dispenser system of claim 1, wherein the first secondary portion extends a first width from the primary portion, and the second secondary portion extends a second width from the primary portion less than the first width.

5. The dispenser system of claim 1, wherein the first secondary portion and the second secondary portion define a cavity including an upper portion having a first width and a lower portion having a second width larger than the first width.

6. The dispenser system of claim 1, wherein the nozzle has a first longitudinal axis and the nozzle adaptor has a second longitudinal axis parallel or substantially parallel to the first longitudinal axis.

7. The dispenser system of claim 1, further comprising one or more control mechanisms configured to control a flow of one or more sealant materials dispensable from the nozzle for sealing at least the segment of the elongated seam at the target area.

8. The dispenser system of claim 1, further comprising one or more control mechanisms configured to control one or more of a position or movement of the nozzle for sealing at least the segment of the elongated seam at the target area.

9. The dispenser system of claim 1, wherein the nozzle adaptor includes a biasing element that mitigates a force applied by the nozzle.

10. The dispenser system of claim 1, further comprising:

one or more first control mechanisms configured to control a flow of one or more sealant materials dispensable from the nozzle; and one or more second control mechanisms configured to control one or more of a position or movement of the nozzle.

* * * * *